US006422110B1

(12) United States Patent
Wurst et al.

(10) Patent No.: US 6,422,110 B1
(45) Date of Patent: Jul. 23, 2002

(54) CUTTING KNIFE FOR SEVERING TOUGH ELASTIC MATERIALS AND PRODUCTION METHOD THEREFOR

(75) Inventors: Bert G. Wurst, Stuttgart; Stefan Gahlert, Aichtal, both of (DE)

(73) Assignee: C & E. Fein GmbH & Co. (DE)

( * ) Notice: Subject to any disclaimer, the term of this patent is extended or adjusted under 35 U.S.C. 154(b) by 0 days.

(21) Appl. No.: 09/624,935

(22) Filed: Jul. 25, 2000

(30) Foreign Application Priority Data

Aug. 12, 1999 (DE) ..... 199 38 115

(51) Int. Cl.[7] ..... B26B 7/00
(52) U.S. Cl. ..... 76/104.1; 30/277.4; 30/350
(58) Field of Search ..... 76/104.1, 119, 76/115, DIG. 6; 30/350, 277.4, 228, 346.54, 272.1

(56) References Cited

U.S. PATENT DOCUMENTS

| | | | | |
|---|---|---|---|---|
| 1,607,083 A | * | 11/1926 | Ignatieff | 76/104.1 |
| 2,093,874 A | * | 9/1937 | Stargardter | 76/104.1 |
| 3,468,195 A | * | 9/1969 | La Cas | 76/104.1 |
| 3,488,844 A | | 1/1970 | Lesh | |
| 4,399,611 A | | 8/1983 | Maringer | |
| 4,543,720 A | | 10/1985 | Grunikiewicz et al. | |
| 4,653,373 A | | 3/1987 | Gerber | |
| 4,980,976 A | * | 1/1991 | Junginger et al. | 30/277.4 |
| 5,216,813 A | * | 6/1993 | Kodachi et al. | 30/228 |
| 5,256,496 A | | 10/1993 | Kluczynski | |

FOREIGN PATENT DOCUMENTS

| | | |
|---|---|---|
| CA | 2161031 A1 | 4/1996 |
| DE | 39 42 230 A1 | 6/1991 |
| DE | 195 30 641 C1 | 11/1996 |
| EP | 0 141 035 A1 | 5/1985 |
| EP | 0 707 921 A2 | 4/1996 |

* cited by examiner

*Primary Examiner*—Douglas D. Watts
(74) *Attorney, Agent, or Firm*—St. Onge Steward Johnston & Reens LLC

(57) ABSTRACT

A cutting knife and a method for production are provided, the knife being suitable for severing tough, elastic material, in particular cement beads of window panes cemented in motor vehicles. The knife comprises a securement portion having a securement receptacle for securing the cutting knife to an oscillatory drive of a cutting tool, and a cutting portion with at least one cutting edge. The cutting knife comprises a plurality of flat bonded layers, which are preferably bonded together by forging. Additionally or alternatively, an outer wear resistant layer is applied, preferably by thermal spraying. The cutting knife has an improved elasticity and increased bending strength in combination with improved cutting properties.

33 Claims, 2 Drawing Sheets

CUTTING KNIFE FOR SEVERING TOUGH ELASTIC MATERIALS AND PRODUCTION METHOD THEREFOR

BACKGROUND OF THE INVENTION

The invention relates to a cutting knife for severing tough, elastic materials, in particular for severing cement beads, e.g. of window panes cemented in motor vehicles or filled in wall joints. The knife comprises a securement portion having a receptacle for securing the cutting knife to an oscillatory drive of a cutting tool, and a cutting portion with at least one cutting edge. The invention further relates to a method for producing such a cutting knife.

DESCRIPTION OF RELATED PRIOR ART

A knife of this type is known from EP-B 0 141 035, while similar knives are disclosed in DE-A 3 626 762 and DE-B 3 838 044. It is well known that such cutting knives are used to remove windshields from motor vehicles when this is necessary due to window damage or leakage of the cement bead. A further application is the removal of leaky silicon joints in brickwork.

Common to the known knives is that when cutting through the cement bead, for example when removing a damaged windshield from a motor vehicle, there is considerable danger of breaking the knife. One reason for this is the tough material of the cement bead which is often made of a certain type of polyurethane. Another reason is the considerable force required especially for cutting through thicker beads, despite the high frequency and the small rotary angle of the oscillatory drive. Wider cement beads occur often for windshields that have already been replaced before, where the cement bead has been applied manually during assembly.

On the other hand, such knives or blades become rapidly dull and must be frequently sharpened due to the very resistant and tough material of the cement bead.

The known knives to date are made of a common steel used for knives. Initially, a flat blank is stamped out of a suitable sheet and is optionally bent when the knife is to have a U-shaped cross section or angled or bent form. Optionally a subsequent treatment by grinding follows. Thereafter, the knife is hardened and ground and optionally polished.

The knife disclosed in EP-B 0 141 035 includes a securement opening in the form of a 12-edged hole for form-fit securement to the drive shaft of an oscillatory drive. In contrast, the cutting knife disclosed in DE-A 3 626 762 is welded to the drive shaft. The knives disclosed in DE-B 3 838 044 are fixed to the drive unit as in the manner of a sabre saw and are driven to oscillate in the axial direction. However, such knives are also made from knife steel, hardened and sharpened before use.

In addition, cutting knives are known through prior use whose surface is provided with a thin layer of titanium nitride, which apparently has been applied by chemical vapor deposition. However, such knives have not proven themselves in practice, since the titanium nitride layer is so thin so as to be practically useless. Already after a single re-sharpening, practically no effect remained. In addition, the production using CVD (chemical vapor deposition) is relatively complicated and expensive. Further, the titanium nitride coated knives are also subject to the above-mentioned problems of breakage.

SUMMARY OF THE INVENTION

An object of the present invention is to provide an improved cutting knife and a method for producing same, which allows improved cutting capacity and reduced susceptibility to breakage thereby allowing increased utility in operation.

This and other objects of the invention are solved by providing a cutting knife comprising a plurality of flat interconnected layers, where at least two of the layers are of a metallic material. In this manner, the object is achieved in that the multi-layer construction of the knife out of a plurality of individual, flat interconnected metal layers provide improved properties of the knife on the whole. Namely, a particularly high hardness and wear resistance is achieved at the cutting edge or edges and at the same time greatly improved elasticity and reduced breakage is achieved.

It has been known for centuries to produce the so-called Damascus blades, i.e. to produce sabres and daggers from individual layers and to forge these together. Even so, it is not obvious to transfer this method to the production of cutting knives for use in conjunction with an oscillatory drive to cut tough, elastic material.

The cutting knives of the present invention are mass-produced articles which are required in large number in repairing joints in brickwork, in automotive workshops and in glass workshops, since the knives become dull in relatively short time or break. Frequently, a knife can be used only once for cutting out a single windshield.

In contrast, the Damascus blades are handmade and are extremely complicated and expensive in production. Such blades today which consist of numerous individual layers forged together cost three or four digit sums in EUROS. The known knives for use together with oscillatory drives have been used since 1983, however one has not considered the use of a knife with a plurality of metal layers.

It is therefore not obvious to transfer such an expensive and complicated procedure to the production of cutting knives of the present type.

In a preferred embodiment of the present invention, the metal layers are connected to one another by heat bonding, preferably forged to one another.

Although forged metal layers basically have particularly good properties, it is also possible to bond the metal layers in other ways. For example, it is contemplated to surface weld the metal layers, which is possible with a special resistance welding process with simultaneous application of pressure. Friction welding is also possible. More recently, it is also possible to bond the different metal layers for this purpose with adhesives.

In a further embodiment of the present invention, some of the individual layers are made of materials having different properties.

In this manner, the properties of the knife can be "custom-made" in a certain sense. For example, central layers can be provided having a reduced hardness, with high tenacity and bending strength. To the outside, the layers can have an increasing hardness and a decreasing tenacity or bending strength and vice versa. Basically it is possible to provide the different layers out of the same material, but having been treated differently, for example having a different degree of deformation (e.g. using cold rolled or annealed steel). The properties can also be produced when later heat treating the bonded layers. However, it is particularly preferred to use special materials whose composition is adapted to the desired properties. This is to achieve a particularly high elasticity and bending strength in a defined region of the cutting portion and in particular to achieve a high hardness and optionally reduced friction in the outer layers at the cutting edge. In some cases it can also be appropriate to produce the outer layers from a soft and/or particularly elastic material. This is advantageous when the cement bead to be removed is located on a painted surface of plastic or wood.

The outer metal layers can also be subjected to a special surface treatment, for example a treatment with boron, carbon, nitro carbon or the like, to achieve a particular high hardness in the outer layers in the area of the at least one cutting edge.

It is also preferred that at least one of the layers comprises a wear resistant material, preferably wolfram carbide, silicon carbide, titanium carbide, chromium oxide, silicon oxide, titanium oxide, aluminum oxide, boron nitride, titanium nitride, molybdenum or mixtures thereof or mixtures and alloys with further metals.

The additional wear resistant layer is a layer which is not made of the same material as the other metal layers, for example a certain type of steel. Rather, it consists of an inorganic material, normally non-metallic, for example a carbide, an oxide or a nitride. To achieve high hardness and wear resistance, a coating of molybdenum is also contemplated.

These additional layers however cannot be applied as the other metal layers by heat bonding or forging, but require a special coating procedure, for example deposition out of the vapor phase or thermal spraying.

In another embodiment of the invention, at least one of the layers of the cutting portion contains friction reducing additives, preferably segregates of molybdenum sulfide and/or graphite.

The work in severing the cement bead is considerably simplified, since the friction is greatly reduced by the friction reducing additives in the form of microscopically small segregates in at least the outer coating. The operation times are also improved.

In a further embodiment of the invention, at least one outer layer of the cutting portion comprises PTFE (Teflon).

The friction when severing a cement bead is greatly reduced by the anti-sticking effect of PTFE. An adhesive effect of the cement material during severing is counteracted. Due to the reduced friction, the temperature in the severing process is reduced, whereby the tendency to form vapors is also reduced. It can also be advantageous to use colored Teflon to indicate different configurations or to improve the aesthetic impression.

In another advantageous embodiment the cutting portion has blade with a crescent-shaped curvature, which is preferably concavely curved relative to the bearing point. The cutting knife may also have a U-shaped, angled cross section, wherein the cutting portion is connected to the securement portion by an intermediate section, as is principally known in the prior art.

It has turned out that with such geometries of the cutting knife a particularly advantageous severing effect can be achieved, and that with a U-shaped, angled cross section a windshield can be removed from the outside. Beyond that, other shapes are contemplated, e.g. angled or bent blades or cutting knives with a roll as stop, as this is principally known from EP-B-0 174 427.

According to a further embodiment of the invention, the cutting knife comprises a securement receptacle that is configured to be connected to a rotary oscillatory drive. In an alternative embodiment of the invention the cutting knife comprises a securement receptacle that is configured to be connected to an oscillatory drive which oscillates in an axial direction.

The cutting knife according to the invention can be advantageously used with both of these securement receptacles.

In a further embodiment the cutting knife has a core region comprising an elastic material and/or soft material.

In another embodiment based thereon, the knife comprises a cutting portion which is provided with the different layers only in the region of the at least one cutting edge.

These measures simplify fabrication of the knife because the core region of elastic and/or soft material can be produced in a relatively simple manner for example by stamping out of a sheet. Simultaneously, a securement receptacle in the form of an opening can also be stamped out, where then the various layers can be applied to the cutting portion to achieve the required properties. If the cutting knife also contains an intermediate portion, the additional layers can naturally also be extended thereto, for example to achieve a high tenacity and bending strength in the region of the intermediate portion.

In this manner, the production is simplified and the production costs are considerably reduced.

According to the present invention, a method is also provided for producing a cutting knife for severing tough, elastic materials, in particular for severing through cement beads e.g. of window panes cemented in motor vehicles, with a securement receptacle for securing the cutting knife to an oscillatory drive of a cutting tool, and a cutting portion with at least one cutting edge. The method comprises the steps of a) producing a plurality of metal layers, b) heat-bonding the metal layers, preferably by forging, to produce a metal blank for the cutting knife, c) heat-treating the blank to improve the hardness and/or break resistance, preferably by hardening and tempering the blank, d) sharpening of the blank by grinding and/or by polishing to produce said at least one cutting edge.

In this way the knife of the present invention is produced with distinctly improved properties which unite a high stability, in particular high tenacity and bending strength with a good hardness and wear-resistance of the cutting edge or edges.

It will be understood that the individual metal layers can be made of differently alloyed metals.

A forging process is preferably used for heat bonding the layers, i.e. bonding with a corresponding high temperature under pressure by hammering or the like. Further, it is contemplated to generate the bond with presses and sufficiently high temperature, as long as the pressing machines are mechanically and thermally stable. It is also possible to form the intimate bond by friction welding or with a special resistance welding procedure while additionally applying surface pressure.

In a preferred embodiment of the present method, the securement opening is formed after the heat treatment of step (c), preferably by electric erosion or laser cutting.

It is difficult when producing the blank by heat bonding several metal layers to achieve the desired dimensions for the securement receptacle, which can for example be an opening in the form of a multi-edged hole, for example a 12-edged hole. The production method is simplified in that a flat metallic blank is initially produced in a suitable process, which can be heat-treated in a suitable manner to obtain the desired mechanical properties, wear resistance and hardness. A spark erosion process or a laser cutting process are suitable for producing the securement receptacle as an opening in relatively inexpensive manner but with sufficiently accurate dimensions.

If the cutting knife should not be flat, but have a certain bending, the blank is bent in the heated state before the heat treatment for improving the hardness and/or break resistance, where a hardening and tempering follows. When using steel, the bending should preferably take place in the red-glowing condition.

Alternative to the above-described method, the knife can be produced from a blank of elastic and/or soft material, where the plurality of metal layers is applied at least to the region of its at least one cutting edge.

As explained above, the production method is simplified and considerably less expensive. Namely, in a further embodiment the blank can be produced of elastic and/or soft material together with the securement receptacle for example by stamping. The various metal layers are used only in the region where special improved properties are necessary, in particular in the region of the cutting portion and optionally the region of the intermediate portion.

If the metal layers are only applied to the cutting portion, the bending to produce a angled U-shaped or bent knife can be performed in the cold condition.

In a further embodiment of the present method, at least one additional wear resistant layer is applied to the cutting portion.

Preferably this layer can be of wolfram carbide, silicon carbide, titanium carbide, chrome oxide, silicon oxide, titanium oxide, aluminum oxide, boron nitride, titanium nitride, molybdenum or mixtures and alloys with further metals.

As mentioned above, a knife with a particularly hard and wear resistant blade can be produced in this manner, however still having sufficient elasticity and bending strength.

The wear resistant layer or layers are preferably applied by deposition from the gas phase (CVD or PVD) or by thermal spraying, preferably plasma spraying.

While only very thin layers can be applied with the CVD or PVD methods, which are complicated and expensive, the use of a thermal spraying process allows a very dense coating with a greater thickness in the range of up to about 1 millimeter.

Only a sufficient thickness of the coating in at least the region of the at least one cutting edge leads to the distinctly improved cutting properties of the knife. A coating of lesser thickness of few micrometers would lose its effect already at the first sharpening or with subsequent sharpenings, since it would be completely removed from the cutting edge.

In a further embodiment of the present method, the wear resistance layer is produced by thermal spraying of carbides in a metal matrix, preferably in nickel, cobalt or alloys thereof.

In this manner, carbides can also be thermally sprayed, where the preferred matrix of nickel, cobalt and other alloys will normally comprise carbide additives in an amount of between 8 and 30 weight percent. When melting the matrix in the flame, it reacts with the carbide to form various mixed phases. Wolfram carbide layers, chromium carbide layers or metal carbides are contemplated. If oxide layers are produced by thermal spraying, their properties can also be improved by mixing and forming alloys. An aluminum oxide layer can be employed mixed with 3 to 40 weight percent titanium oxide, which produces a relatively high hardness with reduced brittleness.

In another embodiment of the present method, friction reducing additives are added to the wear resistant layer. For example, these can be microscopically small segregates of molybdenum sulfide and/or graphite. However, due to the danger of oxidation, a spray application must be done with a protective gas.

In an alternative embodiment of the invention, the method for producing a cutting knife comprises the following steps:

a) producing a blank made of steel, b) heat-treating the blank to produce a high elasticity and break resistance, preferably by tempering the blank, c) sharpening the blank, preferably by grinding and/or polishing, d) applying at least one wear resistant layer to the cutting portion by thermal spraying.

In this manner, a knife can be produced with high elasticity and break resistance which simultaneously has good severing properties.

Compared to the production with a plurality of metal layers, this method is considerably less expensive because the complicated process of heat bonding, for example by forging the individual layers, is no longer present.

In addition, the knife can be produced in the conventional way with a suitable knife steel, which however is subjected to a special heat treatment to achieve a high elasticity break resistance, i.e. not the normal hardening as with conventional knives. An annealing or tempering can follow the hardening to achieve an increase bending strength and elasticity with reduced hardness, as well as an improved break resistance.

The normally insufficient hardness in the region of the at least one cutting edge of such knives is now overcome by the application of a wear resistant layer by thermal spraying. A layer of sufficient thickness can be achieved with the spraying process, so that exceptionally good cutting properties can be achieved in the region of the cutting edge, i.e. a high hardness and wear resistance, even despite the insufficient hardness of the blank.

The wear resistant layer can be produced of molybdenum, a carbide, an oxide, a metal carbide, a metal oxide or mixtures thereof.

As mentioned above, it is again particularly preferred to apply the wear resistant layer by thermal spraying of the carbides, which are contained in a metal matrix, preferably of nickel, cobalt or alloys thereof.

In a further embodiment of the invention, the blank is jet beam roughened before the thermal spraying.

This allows an improved adherence of the thermally sprayed layer to the surface of the blank.

In another embodiment, a layer of bonding agent is applied before spraying on the wear resistant layer.

This provides a further improved adherence of the wear resistant layer to the knife, where disadvantages caused by the differences in thermal expansion coefficients can be partially compensated.

In another preferred embodiment of the present method, the securement receptacle is produced by stamping.

The production process is distinctly simplified and less expensive, as in the case of the conventional production of such knives, however without having improved properties.

In case an angled cross section is to be produced, a bending takes place before the heat treatment according to step (b).

As above, friction reducing additives can be added to the wear resistant layer, preferably segregates of molybdenum sulfide and/or graphite.

It will be understood that the above-mentioned and following features of the invention are not limited to the given combinations, but are applicable in other combinations or taken alone without departing from the scope of the invention.

BRIEF DESCRIPTION OF THE DRAWINGS

Further features and advantages of the invention will become apparent from the following description of preferred embodiments taken in conjunction with the drawings.

Figure 1:
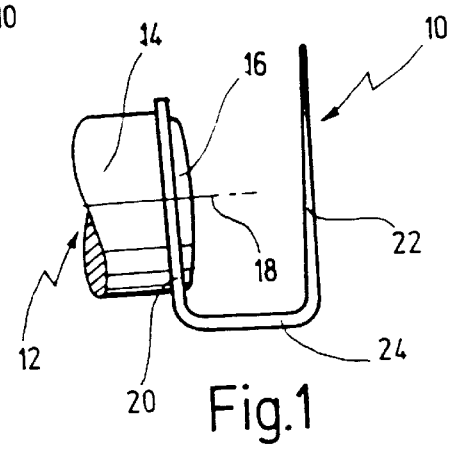
FIG. 1 shows a front view of a cutting knife according to the present invention, where an oscillatory drive is also illustrated to which the knife is secured.

A cutting knife according to the invention is shown in FIG. 1 generally designated with the numeral 10. The knife 10 is used together with an oscillatory drive unit 12 with rotary oscillation, which is only schematically illustrated in FIG. 1. Its drive shaft 14 produces high frequency in the range between about 5,000 and 28,000 vibrations per minute with a small rotary angle in the range of between 0.5° and 7° about the axis of the drive shaft.

The knife 10 in FIG. 1 has a U-shaped, angled cross section and comprises a securement portion 20 and a crescent-shaped cutting portion 22, which is connected to the securement portion 20 by an intermediate bridge 24.

Figure 2:
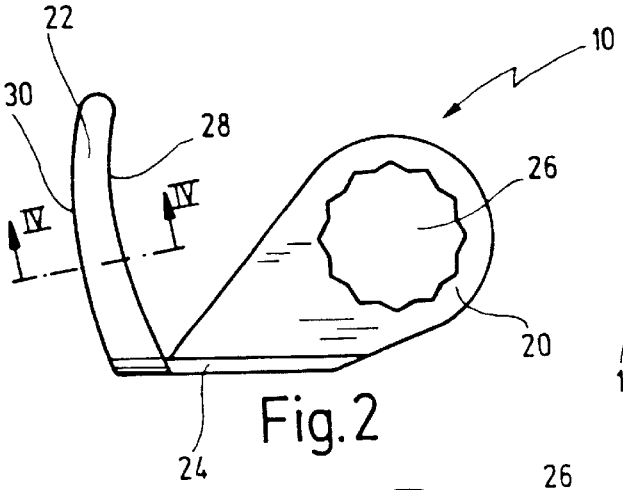
FIG. 2 shows a view of the knife of FIG. 1.

As seen in FIG. 2, the securement portion 20 has a securement receptacle 26 in the form of an opening, which is configured as a regular multiple-edged opening, in the illustrated case as a star-shaped 12-edged opening. This allows a form-fit securement of the knife on the drive shaft 14. A screw 16 is also provided which is screwed into a threaded bore hole in the shaft 14 (not shown).

Figure 3:
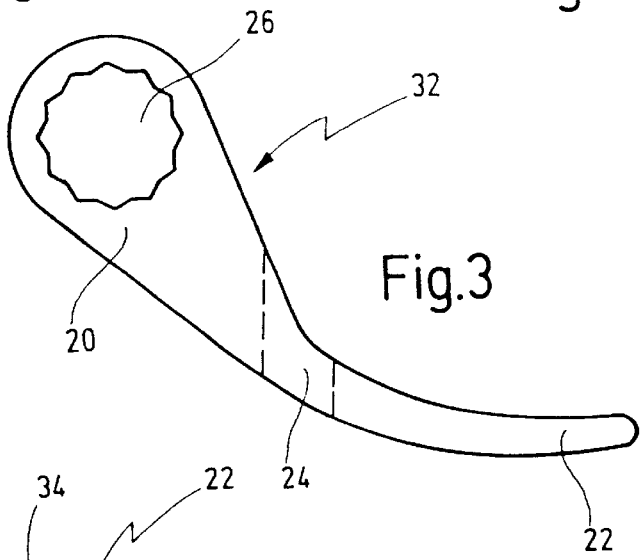
FIG. 3 shows a so-called pre-form of the knife of FIG. 2, i.e. a flat blank from which the knife of FIGS. 1 and 2 is formed by bending.

A flat blank 32 is illustrated in FIG. 3, from which the knife 10 of FIGS. 1 and 2 can be produced by bending and further processing steps. Although the illustrated knife 10 has a U-shaped, angled cross section, other shapes are possible. In addition, a flat knife as in the form of the blank 32 can be the final form of the knife. Further, the knife can also have a bent form or a flat form and optionally can be provided with a stop for limiting the cutting depth, as disclosed for example in DE-A 3 304 981 and EP-B 0 174 427.

Such variations are shown in FIGS. 6, 8, 9 and 10 as examples.

Figure 6:
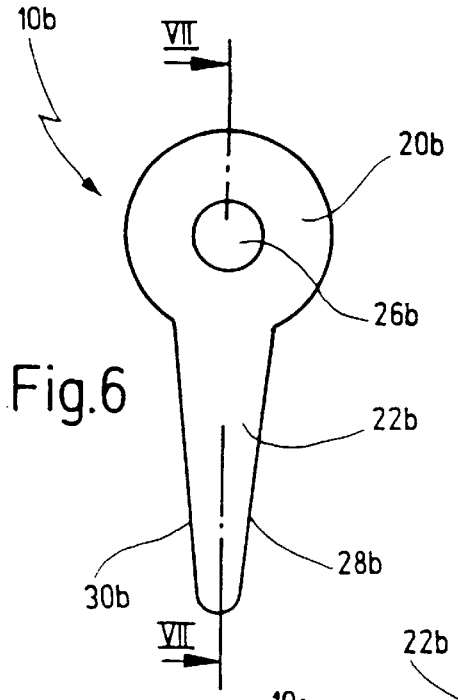
FIG. 6 shows a view of a further modification of the knife according to the present invention.
Figure 8:
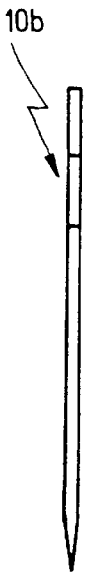
FIG. 8 shows a side view of the knife of FIG. 6.
Figure 9:
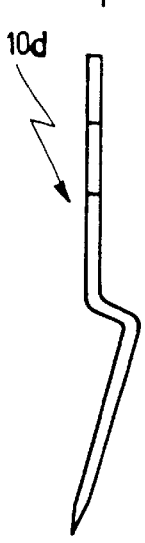
FIG. 9 shows a modification of the knife of FIG. 8 having a bent section.

The knife 10*b* in FIGS. 6 and 8 is flat and includes a securement portion 20*b* with a round securement receptacle 26*b* and a cutting portion 22*b* with two straight cutting edges 28*b* and 30*b*. Starting from the securement portion 20*b*, the two edges run to a common tip which is rounded so that an approximately wedge-shaped cutting portion 22*b* results. FIG. 9 shows a knife 10*c* having a bent or knee section, while FIG. 10*b* illustrates a curved cutting knife 10*d*.

The knife according to the present invention is distinguished through the particular manner of fabrication, which is discussed in the following.

According to a first aspect of the invention, the knife 10 is made of a plurality of thin metal layers, which are bonded to one another in a forging process. The individual layers can be stamped out of thinly rolled sheet metal, before being forged together. The sheet preferably consists of steel, in particular a composition suitable for knives, where the different layers can be of different steels with different compositions, to achieve the "custom-made" properties of the knife 10.

Figure 4:
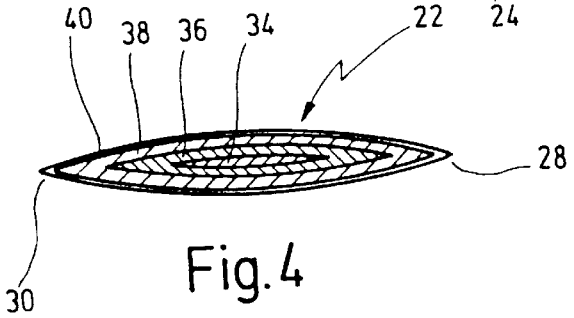
FIG. 4 shows a cross section of the cutting portion of FIG. 2 along the line IV—IV in enlarged and schematic representation.

As shown in FIG. 4, the cutting portion 22 can be ground to have a crown on both sides and have a cutting edge 28 and 30 at both ends. It can be formed of a central layer 34 followed by a layer 36 and an outer metal layer 38, which is then fully surrounded on its outer side by a wear resistant layer 40 applied by thermal spraying.

It will be understood that the illustration in FIG. 4 is purely schematic in nature and is only intended to indicate the construction of the cutting portion 22 with the individual layers 34 to 40. The number of layers can also be a multiple of the illustrated number.

In the production, the individual metal layers 34, 36, 38 of the blank, after their production by stamping, are bonded to one another by forging. The securement opening 26 is preferably produced after the forging process, however before applying the thermal spray layer 40.

As in the production of conventional knives, the stamping process is not simple so that the securement opening 26 is preferably produced by a spark erosion method or by laser cutting, which is relatively inexpensive but allows high tolerances.

After forging the individual layers 34, 36, 38, the blank 32 is bent in the red-glowing state to form the U-shaped, angled form of the knife.

Thereafter, a hardening or a tempering of the knife 10 follows which provides high elasticity and break resistance of the core layer 34. These properties diminish over layer 36 and going out to layer 38, however the wear resistance and hardness increase.

These customized properties can be further improved by the material selection of the inner layers 34 or 36 and the outer layer 38, so that after the heat treatment in the core region a high elasticity, tenacity and bending strength are achieved. In the outer region a high hardness and wear resistance is achieved but at the expense of a reduced bending strength. In some cases it is also appropriate to provide a soft layer to the outside, e.g. when the cement bead is applied to a painted surface of plastic or wood.

After bending and heat treating the knife 10, it is simply coated on both sides in the region of cutting portion 22 by spray application of the layer 40 through thermal spraying, preferably plasma spraying.

This layer 40 is preferably an oxide or carbide layer, optionally with metal additives, or a molybdenum layer, which at the same time has a high hardness and wear resistance.

An advantage of the use of thermal spraying for the outer layer 40 is that the layer 40 can be applied with a sufficient thickness on the order of a few 1/10 ths up to about 1 millimeter or more in a relatively inexpensive manner. The layer has a sufficient thickness to maintain the favorable cutting properties even after several resharpenings during use of the knife 10. The sprayed layer 40 can be made of wolfram carbide contained in a matrix of nickel, cobalt or their alloys and the amount of metal lies between 8 and 30 weight percent. For example, this can be metal carbide 85 WC to 15 Co—Cr, which displays a high hardness at relatively high break resistance. The coating can also be chosen such that the thermal expansion coefficient is adapted as far as possible to the expansion coefficient of the metal blank. A better adherence under thermal load is achieved and peeling is avoided.

Figure 5:
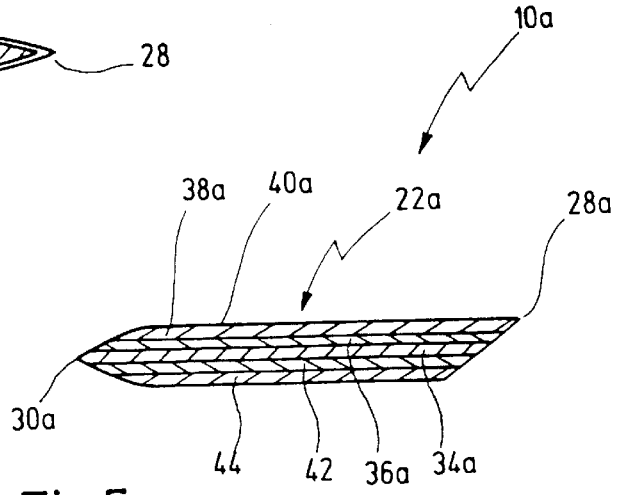
FIG. 5 shows a cross section of the cutting portion of FIG. 2 along the line IV—IV in enlarged and schematic representation, however with a slightly modified form.

An alternative cross section of the cutting portion is shown in FIG. 5 and designated generally with the numeral 22*a*. The cutting portion 22*a* again comprises several layers of a knife steel. The cross section however is basically rectangular and is simply ground off at an angle to form a cutting edge 28*a* on the side facing the securement opening 26. On the side opposing the securement opening 26, a cutting edge 30*a* ground on both sides is provided, which however is not so sharp as the cutting edges shown in FIG. 4.

This edge 30*a* serves only as an "reserve edge", which is used to return the knife back through a section of the cement bead already cut.

Thus it is not so important that the individual metal layers 30*a*, 36*a*, 38*a* and 42, 44 have a high hardness and wear resistance in the region of the edge 30*a*.

While the cutting portion 22 of FIG. 4 has its outer layers 36 or 38 forged around the core layer 34 from both sides, so that a crowned or bulged cross section arises in the forging process, the layers 34*a*, 36*a*, 38*a* and 42, 44 in FIG. 5 are bonded together by forging in substantially flat manner. The central layer 34*a* is especially selected for high elasticity and bending strength and the adjacent layers 36*a* and 42*a* for less elasticity, but instead higher hardness and wear resistance. Thus a particularly high hardness and wear resistance is selected for the side 38*a* on which the wedge-shaped cutting edge 28*a* is formed.

In addition, a thermally sprayed layer 40*a* can be applied as shown in FIG. 5. The outer layer 44 on the other side of the cutting portion 22*a* is not designed for high hardness but more for good elasticity and bending strength, since this side is not provided with a cutting edge.

As already mentioned, the second edge 30*a* on the side opposing the securement opening 26 need not have particularly good cutting properties, since it is only used in reserve.

In another embodiment, the blank 32 can be stamped out of a knife steel of suitable thickness in a single process. The securement opening 26 can be stamped out at the same time. In this case, the properties of the knife steel are chosen for high elasticity and bending strength, which are also a consideration for the following heat treatment, optionally after a previous bending process. Thus the knife steel is not only hardened as otherwise done, but preferably first hardened and thereafter annealed for a sufficient time and at a sufficient temperature. A tempering is attained which results in a good bending strength. The necessary sharpness of the cutting edge 28*a* in this case is obtained through one or more thermal applications to form the layer 48, which must be sufficiently thick for this purpose. Such a layer preferably has a thickness of 0.5 to 1 millimeter. To achieve a better adherence of this wear resistant layer 40*a* to the metal base, the layer is mechanically treated before thermal spraying. For example, the metal base is burred, ground and optionally polished, whereafter it is then subjected to a roughening (fine sand jets with corundum or the like). A layer of bonding agent is then applied after which the wear resistant layer 40*a* is spray applied, which can optionally be performed in several layers to attain the desired thickness.

As mentioned above, the wear resistant layer 40*a* can be an oxide or carbide layer or also a molybdenum layer.

Optionally, friction-reducing additives as microscopic segregates can also be provided in the wear resistant layers 40 or 40*a*. The additives can be molybdenum sulfide or graphite, where then the thermal spray application is performed under a protective gas to avoid oxidation.

The cutting knife of FIG. 5 is preferably sharpened only on one side as illustrated. This is to avoid loss of the wear resistant affect in the region of the cutting edge 28*a*, which would be the case if the edge were sharpened on both sides.

The cutting knife 10*b* shown in FIGS. 6 and 8 differs from the above-described embodiment in another aspect.

Namely, the knife 10*b* is produced from a blank of elastic and/or soft material, where a plurality of metal layers is applied only to the region of the cutting portion. This provides the desired improved properties in the region of the cutting edges, namely high tenacity and bending strength and on the other hand a high hardness at the outer layers in the region of the cutting edges 28*b* and 30*b*.

Figure 7:
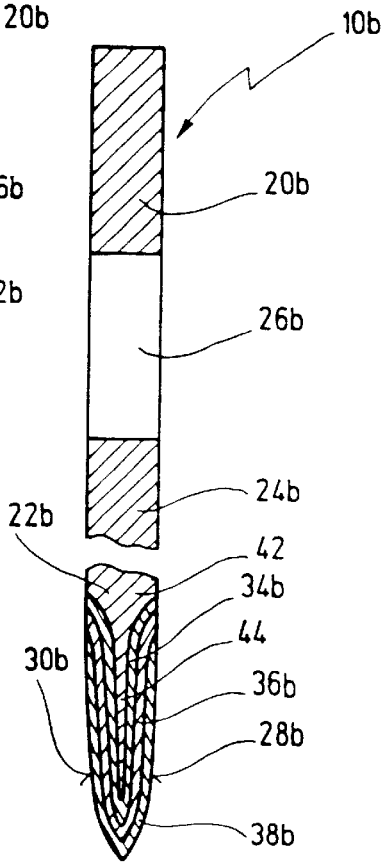
FIG. 7 shows a cross section of the knife of FIG. 6 along the line VII—VII in enlarged representation.

This construction is shown in FIG. 7, which is a cross section along the line VII—VII of FIG. 6 in enlarged representation.

The knife 10*b* has a core region 42 produced from a relatively soft but relatively elastic and tough steel, where the core region extends substantially over the securement portion 20*b*. In the region of the cutting portion 22*b* various metal layers 34*b*, 36*b* and 38*b* are applied on both sides in sequence on the core region 42 starting from a thin projection piece 44. While the projection piece 44 comprises the material of the core region 42, the layers 34*b*, 36*b* and 38*b* may be of other materials, preferably steel, in order to achieve high stability and elasticity as well as high hardness in the region of the outer layer 38*b* at the edges 28*b* and 30*b*.

With this knife construction, production is considerably simplified and less expensive since the complicated production, for example by forging the metal layers 34*b*, 36*b* and 38*b* is only limited to the cutting portion 22*b*. At the same time the production of the blank is less expensive, for example by stamping including the securement receptacle 26*b* formed as a circular opening.

Figure 11:
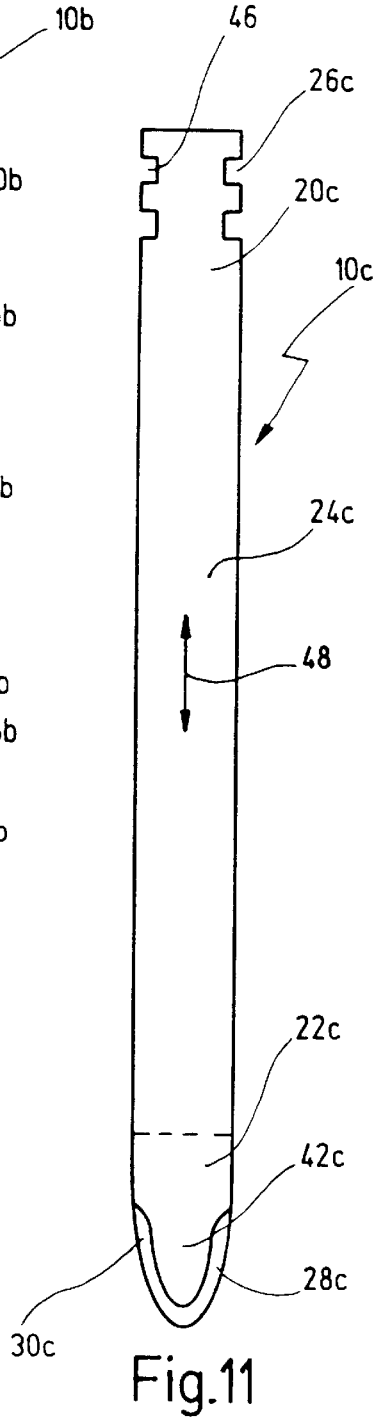
FIG. 11 shows a further embodiment of the present cutting knife suitable for connection to an axial oscillatory drive.

A further embodiment of the knife according to the present invention is shown in FIG. 11 and designated generally with the numeral 10*c*.

The knife 10*c* in contrast to the above embodiments is not suitable for connection to a rotary oscillatory drive, but to an axial oscillatory drive as indicated by the arrow 48. Retaining means 26*c* are provided at the machine end of the knife 10*c*. They include double-sided recesses 46 with which the knife can be spanned for axial oscillatory drive as in a sabre saw. A cutting portion 22*c* is formed at the lower end of the knife 10*c*, which again comprises a core region 42*c*. Metal layers are applied at both sides to the core region as discussed in conjunction with FIG. 7 to form the cutting edges 28*c*and 30*c*.

Such a cutting knife can be employed as described for example in DE-A 3 838 044.

Figure 10:
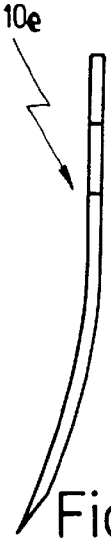
FIG. 10 shows a further modification of the knife of FIG. 8 with a bowed section.

Further embodiments of the present invention are illustrated in FIGS. 9 and 10 and generally indicated with the numerals 10*d*and 10*e*. The cutting knife 10*d* in FIG. 9 comprises a bent or knee section, while the knife 10*e* in FIG. 10 is curved or bowed.

What is claimed is:

1. A method for producing a cutting knife for severing a tough, elastic material, the cutting knife comprising a securement portion having a securement receptacle for securing the cutting knife to an oscillatory drive of a cutting tool, and a cutting portion with at least one cutting edge; the method comprising the steps of:

(a) producing a plurality of metal layers;

(b) heat bonding said metal layers to produce a metallic blank for said cutting knife;

(c) heat treating said blank; and (d) sharpening said blank to produce said at least one cutting edge.

2. The method of claim 1, wherein the step (b) of heat bonding said metal layers includes the step of forging said metal layers.

3. The method of claim 1, wherein the step (c) of heat treating said blank includes at least one step included in the group consisting of the steps of: hardening said blank and tempering said blank.

4. The method of claim 1, wherein the step (d) of sharpening said blank includes at least one step included in the group consisting of the steps of: grinding said blank and polishing said blank.

5. The method of claim 1, wherein said securement receptacle is formed after the heat treatment of step (c).

6. The method of claim 5, wherein said securement receptacle is formed by electric erosion.

7. The method of claim 5, wherein said securement receptacle is formed by laser cutting.

8. The method of claim 1 wherein the step (a) of producing a plurality of metal layers includes the steps of:

(a1) producing a core made of an elastic material;

(a2) applying said plurality of metal layers onto said core at least in said cutting portion.

9. The method of claim 8, wherein said cutting portion extends up to 5 mm around said at least one cutting edge.

10. The method of claim 8, wherein said core made of an elastic material is produced together with said securement receptacle by stamping.

11. The method of claim 8, wherein said blank is bent to produce an angled shaped cross section.

12. The method of claim 11, wherein said cross section is U-shaped.

13. The method of claim 1, wherein at least one wear resistant layer is applied to said cutting portion.

14. The method of claim 13, wherein said wear resistant layer is produced from one out of the group consisting of: wolfram carbide, silicon carbide, titanium carbide, chromium oxide, silicon oxide, titanium oxide, aluminum oxide, boron nitride, titanium nitride, molybdenum or mixtures thereof.

15. The method of claim 13, wherein the at least one wear resistant layer is applied by a step of thermal spraying.

16. The method of claim 15, wherein the step of thermal spraying includes one step out of the group consisting of: plasma spraying, CVD spraying and PVD spraying.

17. The method of claim 13, wherein said wear resistant layer is produced by thermal spraying of carbides being contained in a metallic matrix.

18. The method of claim 17, wherein said metallic matrix comprises one out of the group consisting of: nickel, alloys of nickel, cobalt and alloys of cobalt.

19. The method of claim 13, wherein said wear resistant layer contains friction-reducing additives.

20. The method of claim 19, wherein said friction-reducing additives are chosen from the group consisting of: segregates of molybdenum sulfide and graphite.

21. A method for producing a cutting knife for severing a tough, elastic material, the cutting knife comprising a securement portion having a securement receptacle for securing the cutting knife to an oscillatory drive of a cutting tool, and a cutting portion with at least one cutting edge; the method comprising the steps of:

(a) producing a blank made of steel;

(b) heat treating said blank;

(c) sharpening the blank; and (d) applying at least one wear resistant layer to said cutting portion by thermal spraying.

22. The method of claim 21, wherein the step (b) of heat treating said blank includes the step of tempering said blank.

23. The method of claim 21, wherein the step (c) of sharpening said includes at least one step included in the group consisting of the steps of: grinding said blank and polishing said blank.

24. The method of claim 21, wherein said wear resistant layer comprises one of the group consisting of: molybdenum, a carbide, an oxide, a metal carbide, a metal oxide and mixtures thereof.

25. The method of claim 21, wherein said wear resistant layer is produced by thermal spraying of carbides being contained in a metallic matrix.

26. The method of claim 25, wherein said metallic matrix comprises one out of the group consisting of: nickel, alloys of nickel, cobalt and alloys of cobalt.

27. The method of claim 21, wherein said blank is subjected to jet beam roughening before the step (d) of thermal spraying.

28. The method of claim 21, wherein a layer of bonding agent is applied before the step (d) of thermal spraying.

29. The method of claim 21, wherein said blank along with said securement receptacle is produced by stamping.

30. The method of claim 21, wherein said blank is bent to produce an angled cross section before the step (b) of heat treating.

31. The method of claim 30, wherein said cross section is U-shaped.

32. The method of claim 21, wherein said wear resistant layer includes friction-reducing additives.

33. The method of claim 32, wherein said friction-reducing additives are chosen from the group consisting of: segregates of molybdenum sulfide and graphite.

* * * * *